US007442106B1

(12) United States Patent
Menow et al.

(10) Patent No.: US 7,442,106 B1
(45) Date of Patent: Oct. 28, 2008

(54) REUSABLE PIÑATA SYSTEM AND METHOD OF OPERATION

(76) Inventors: Patricia Menow, 1239 Ward Dr., Yardley, PA (US) 19067; Steven Menow, 1239 Ward Dr., Yardley, PA (US) 19067

( * ) Notice: Subject to any disclaimer, the term of this patent is extended or adjusted under 35 U.S.C. 154(b) by 472 days.

(21) Appl. No.: 10/920,972

(22) Filed: Aug. 19, 2004

(51) Int. Cl.
*A63H 33/00* (2006.01)

(52) U.S. Cl. ..... 446/5; 446/73; 446/76; 446/365; 446/475

(58) Field of Classification Search ..... 446/4, 446/5, 71, 73, 76, 475, 489, 365; 383/9, 383/22, 26; 221/67, 68, 156, 164, 171
See application file for complete search history.

(56) References Cited

U.S. PATENT DOCUMENTS 3,228,556 A * 1/1966 Nonestied ..... 221/279
4,167,078 A 9/1979 Oquita ..... 46/11
4,174,048 A * 11/1979 Volpe, Jr. ..... 221/267
4,848,593 A * 7/1989 Jeandaud ..... 221/207
5,934,516 A * 8/1999 Strycharske et al. ..... 222/158
6,763,971 B1 * 7/2004 Tong ..... 221/151
6,860,403 B1 * 3/2005 Mehrens et al. ..... 221/265
6,918,509 B2 * 7/2005 Baker et al. ..... 221/266

* cited by examiner

*Primary Examiner*—Nini Legesse
(74) *Attorney, Agent, or Firm*—LaMorte & Associates

(57) ABSTRACT

A reusable piñata system having a hollow body with an open bottom end. Slots are disposed in the hollow body. An end cap is provided to obstruct the open bottom end of hollow body. A support element is coupled to the end cap. The support element extends into the hollow body through the open bottom end. The support element is selectively positionable between a closed position, where the support element holds the end cap element in obstruction of the open bottom end, and an open position where the support element holds the end cap element away from the open bottom end. Removable pull pins are inserted through the slots in the hollow body. The pull pins extend into the hollow body where some of the pull pins engage the support element. The pull pins that do engage the support element hold the support element in the closed position.

15 Claims, 5 Drawing Sheets

REUSABLE PIÑATA SYSTEM AND METHOD OF OPERATION

BACKGROUND OF THE INVENTION

1. Field of the Invention

The present invention relates to piñatas and other novelty devices that hold a volume of candy or toys that are dispensed when the novelty device is opened. More particularly, the present invention relates to piñatas and like novelty devices that are refillable and reusable.

2. Description of the Related Art

Traditionally, a piñata is a figure that is filled with candy or small prizes. The figure is suspended and struck with a stick until it is broken and the contents spill onto the floor. The original piñatas were made from clay pots and the word piñata comes from the word 'pignatta' which means fragile pot. In Europe, the tradition of filling a piñata and striking it became religious activity associated with the first Sunday of lent. This religious tradition spread to Spain in the $14^{th}$ century. Spanish missionaries then brought this tradition to the Americas. Native Aztec Indians had a similar game to celebrate the Aztec god of war and soon the two traditions merged.

Over the years, the use of a piñata changed from a religious activity to a celebration activity. Piñatas are now used to celebrate holidays and special days, such as birthdays.

Modern piñatas are no longer made of clay. Rather, for the sake of both cost and safety, most piñata are made of papier-mâché. However, the piñata is still filled with candy and small toys. The piñata is also still broken open by having blindfolded children take turns swinging a stick and trying to strike the piñata.

The act of blindfolding a child and then having that child swing a stick wildly toward a piñata presents obvious dangers. Often a blindfolded child swings a stick and strikes another child or a breakable object. Furthermore, when a child does strike a piñata, the piñata typically does not open fully. Rather, it opens a little and some candy falls out. This causes other children to run to the piñata while the blindfolded child is still swinging the stick. Again an obvious danger is presented.

In an attempt to make piñatas less dangerous, piñatas have been redesigned with non-violent release mechanisms. For instance, in U.S. Pat. No. 4,167,078, to Oquita, entitled Pull-Pin Piñata, a piñata is shown having a hidden door. Numerous strings are loosely glued to the door. Only one of the strings is tied to the door. If a child pulls one of the loosely glued strings, the string pulls free and the door remains closed. However, when a child pulls the one tied string, the door opens and the contents of the piñata fall to the floor.

Such prior art pull-string piñatas share one undesirable feature with traditional struck piñata. That feature is the inability to conveniently reassemble and refill the piñata so it can be used again. Thus, a piñata has remained a disposable, one-use item.

A need therefore exists for a new piñata design that has a non-violent release mechanism, yet enables the piñata to be repeatedly refilled and reused. This need is met by the present invention as described and claimed below.

SUMMARY OF THE INVENTION

The present invention is a reusable piñata system and its associated method of use. The piñata system uses a hollow body having an open bottom end. A plurality of slots are disposed in the hollow body. An end cap is provided to selectively obstruct the open bottom end of hollow body. However, the end cap is biased away from the open bottom end of the hollow body by gravity.

A support element is coupled to the end cap. The support element extends into the hollow body through the open bottom end of the hollow body. The support element is selectively positionable between a closed position, where the support element holds the end cap element in obstruction of the open bottom end, and an open position where the support element holds the end cap element away from the open bottom end. A plurality of removable pull pins are provided and are inserted through the slots in the hollow body. The pull pins extend into the hollow body and only some of the pull pins engage the support element. The pull pins that do engage the support element hold the support element in the closed position. Once the proper sequence of pull pins is removed, gravity causes the end cap to fall away from the open end of the hollow body and the support element falls to its open position.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

As with traditional piñatas, the present invention piñata can be made in many shapes and styles. In the shown embodiment of the present invention piñata, the piñata has a simple rectangular outer shape. Such a body shape is merely exemplary and is used to clearly illustrate the working components of the present invention piñata. It will therefore be understood that the present invention piñata can also be produced in many different shapes and that the shown embodiment is not a limitation on the body appearances the present invention piñata may take.

Figure 1:
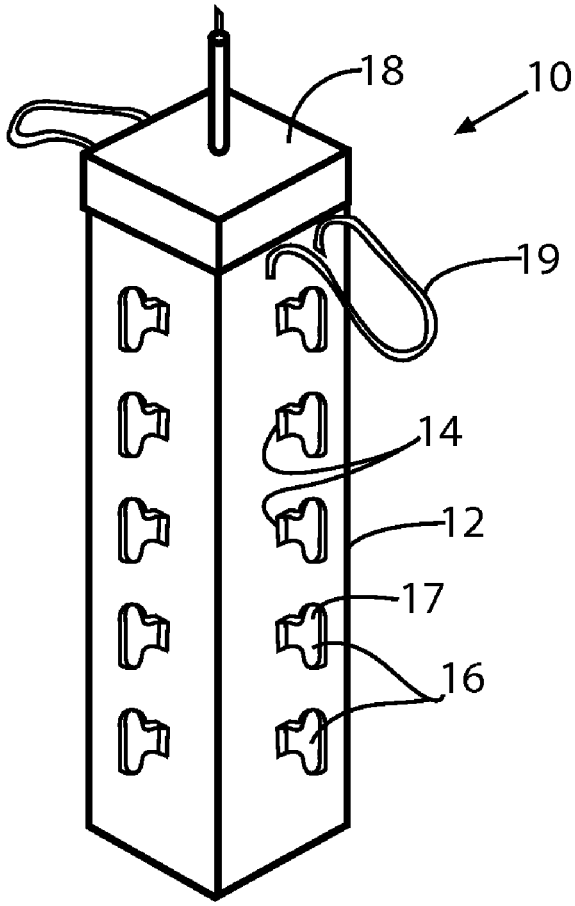
FIG. 1 is a perspective view of an exemplary embodiment of the present invention piñata system.

Referring to FIG. 1, an exemplary embodiment of a reusable piñata system 10 is shown. The piñata system 10 includes a hollow body 12. As has been mentioned, the hollow body 12 can be made into many forms and is rectangular in the exemplary embodiment.

Slots 14 are formed in the hollow body 12. Pull pins 16 are inserted into the slots 14. The pull pins 16 preferably have enlarged heads 17 so that the heads of the pull pins can be easily grasped and pulled. The hollow body 12 is filled with candy, small prizes and the like. The volume of the prizes can be selectively controlled and is limited only by the size of the tubular body 12.

To utilize the piñata system, the hollow body 12 is filled with candy and/or prizes and is suspended using handle straps 19 or similar tethers. Once the hollow body 12 is filled and suspended, children take turns removing the pull pins 16. When certain of the pull pins 16 are removed, the contents of the hollow body 12 are released from the bottom of the hollow body 12 and are allowed to fall to the floor. The pull pins 16 that need to be removed can be determined by viewing the exterior of the hollow body 12. Consequently, a child cannot determine which of the pull pins 16 will cause the candy and prizes to be released.

After the candy and prizes are released, the pull pins 16 can be reinserted. The hollow body can be refilled and the piñata system 10 is ready to be used again.

Figure 2:
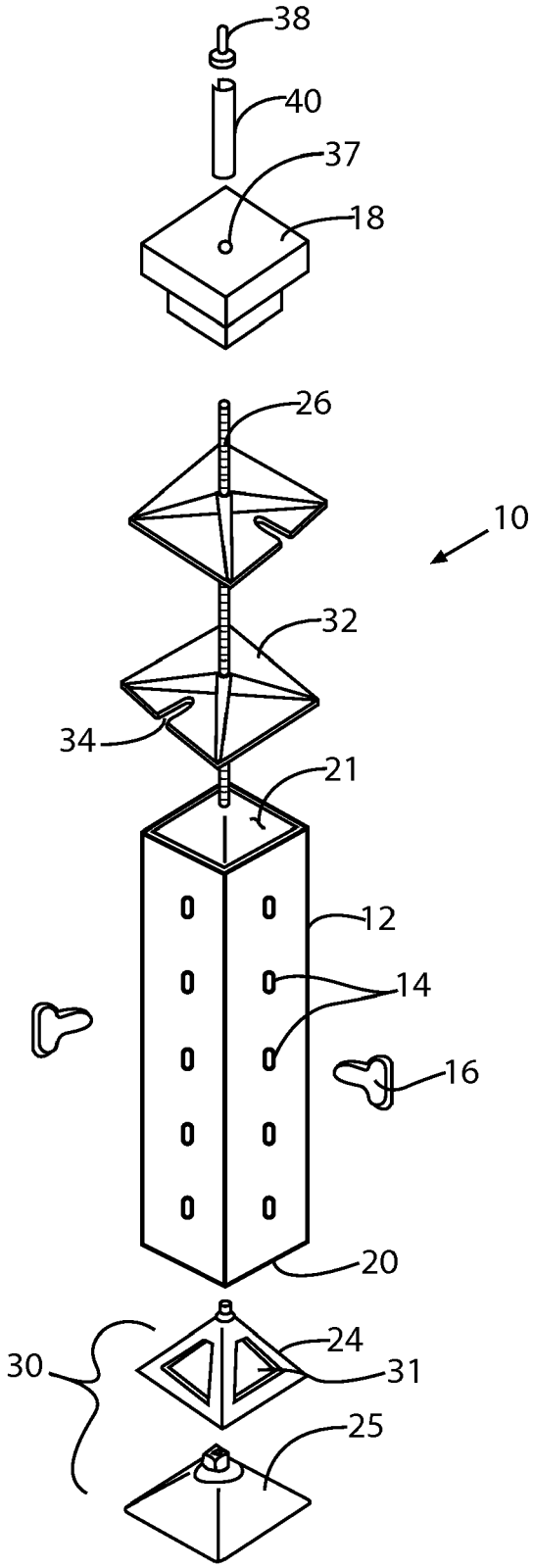
FIG. 2 is an exploded view of the embodiment shown in FIG. 1.
Figure 3:
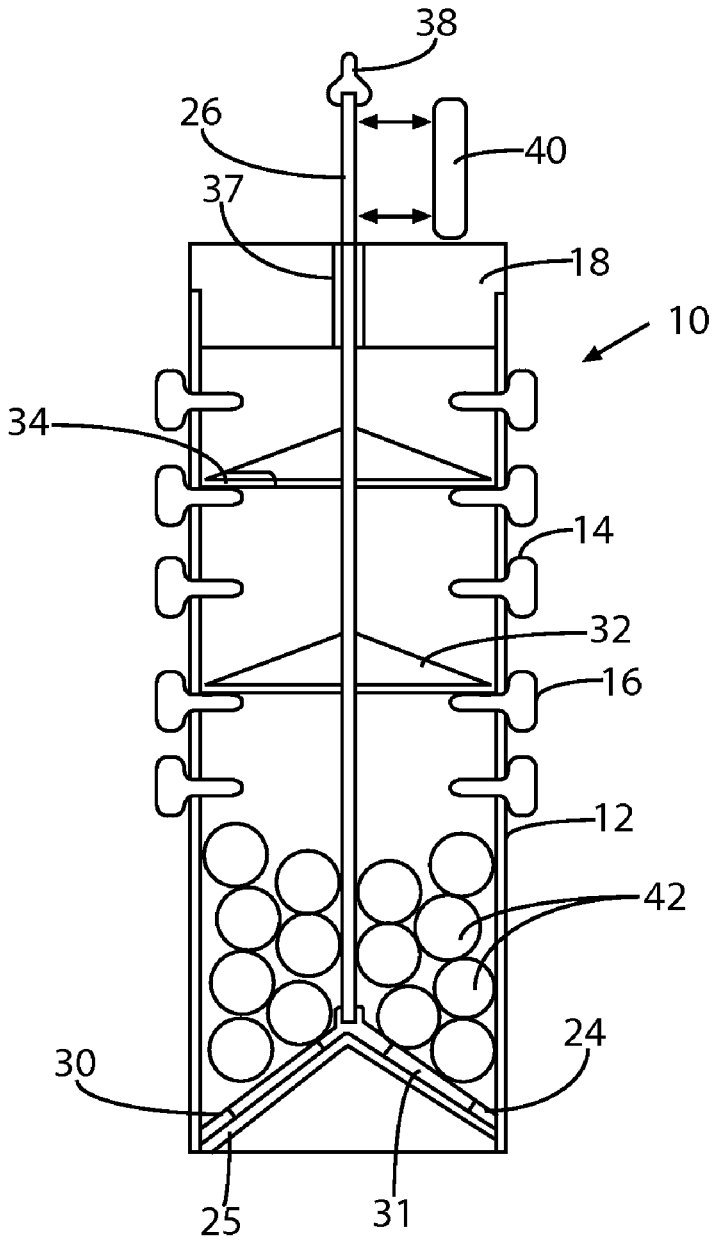
FIG. 3 is a selectively cross-sectioned view of the embodiment shown in FIG. 1, wherein the piñata system is in a closed position.

Referring now to both FIG. 2 and FIG. 3, the mechanics of the piñata system 10 are explained. The hollow body 12 is tubular in shape, having an open top end 21 and an open bottom end 20. Multiple slots 14 are formed along all sides of the hollow body 12. A pull pin 16 is provided for each of the slots 14.

A top lid 18 is provided to cover the open top end 21 of the hollow body 12. On the opposite side of the hollow body 12, an end cap assembly 30 is provided to obstruct the open bottom end 20. The end cap assembly 30 includes a funnel barrier 24. The funnel barrier 24 is pyramidal in shape. Small fill openings 31 are disposed in the side surfaces of the funnel barrier 24. These fill openings 31 are used to fill the hollow tube 12, as will later be explained.

The end cap assembly 30 also includes a removable cap 25. The removable end cap attaches to the underside of the funnel barrier 24 and obstructs the fill openings 31. Thus, no material can pass through the fill openings 31 of the funnel barrier 24 when the removable cap is attached to the funnel barrier 24.

A shaft 26 or equivalent support element is provided. The shaft 26 extends down the center of the hollow body 12. The bottom of the shaft 26 attaches to the funnel barrier 24 in the end cap assembly 30. The end cap assembly 30 is sized to completely obstruct the open bottom end 20 of the hollow body 12 when positioned within the open bottom end 20 of the hollow body 12.

The shaft 26 is attached to the funnel barrier 24. As such, the shaft 26 and the end cap assembly 30 move in unison.

A plurality of keyed platforms 32 are provided inside the hollow body 12. The keyed platforms 32 selectively attach to the shaft 26 at different positions. In the shown embodiment, only two keyed platforms 32 are shown to simplify the illustration. This number is merely exemplary and it should be understood that one or any plurality of keyed platforms 32 can be used. In the shown embodiment, there are five levels of pull pins 16. Thus, up to five keyed platforms 32 can be used, wherein one keyed platform 32 exists for each level of pull pins 16.

Each keyed platform 32 is a solid platform having an area that matches the cross-sectional area of the interior of the hollow body 12. As such, each of the keyed platforms 32 obstructs the interior of the hollow body 12. At least one key slot 34 is formed on each of the keyed platforms 32. The key slots 34 linearly align with the slots 14 in the wall of the hollow body 12.

The shaft 26 extends through a hole 37 in the top lid 18. However, the shaft 26 does not engage the top lid 18. A stop cap 38 is attached to the top end of the shaft 26. The stop cap 38 is affixed to the shaft 26 and is larger than the hole 37 in the top lid 18. Consequently, the shaft 26 is free to reciprocate through the hole 37 in the top lid 18 until either the stop cap 38 or a keyed platform 32 abuts against the top lid 18.

A removable spacer 40 is provided that fits around the shaft 26. The removable spacer 40 is placed between the stop cap 38 and the top lid 18 before the piñata system 10 is readied for use. The removable spacer 40 holds the stop cap 38, and thus the top end of the shaft 26, a predetermined distance above the top lid 18. This elevated position corresponds to the position where the shaft 26 holds the end cap 30 in obstruction to the bottom of the hollow body 12.

Figure 4:
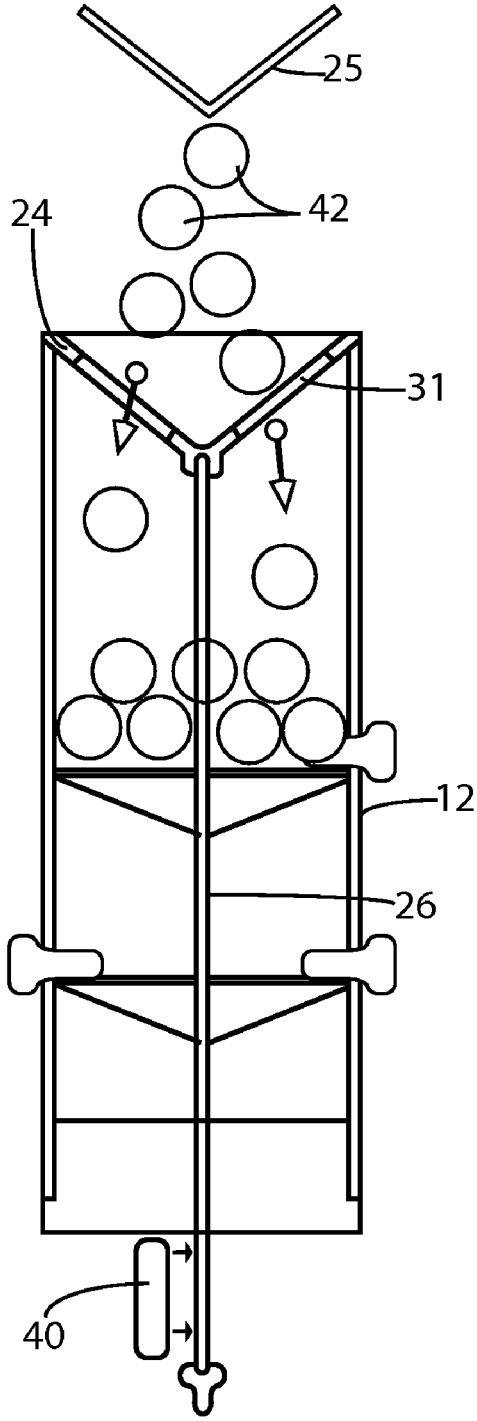
FIG. 4 is a selectively cross-sectioned view of the embodiment of FIG. 1 shown being filled.

Referring solely to FIG. 4, it can be seen that to fill the hollow body 12 with candy or prizes 42, the hollow tube 12 is momentarily inverted. The spacer 40 is attached to the shaft 26 to lock the shaft in place. The pull pins 16 are placed through the slots 14 in the sides of the hollow body 12. The removable cap 25 is removed and candy and prizes 42 are poured into the hollow body 12. The funnel barrier 24 acts as a funnel and guides the candy and prizes 42 into the hollow body 12. The candy and prizes 42 pass through the fill openings 31 in the funnel barrier. This helps regulate the flow of candy and prizes 42 into the hollow body 12 and prevent the hollow body 12 from becoming overfull. Once the hollow body 12 is filled with a desired volume of candy and prizes 42, the removable cap 25 is connected to the funnel barrier 24, thereby closing the fill openings 31. The piñata system can then be turned right side up and is ready for use.

Figure 5:
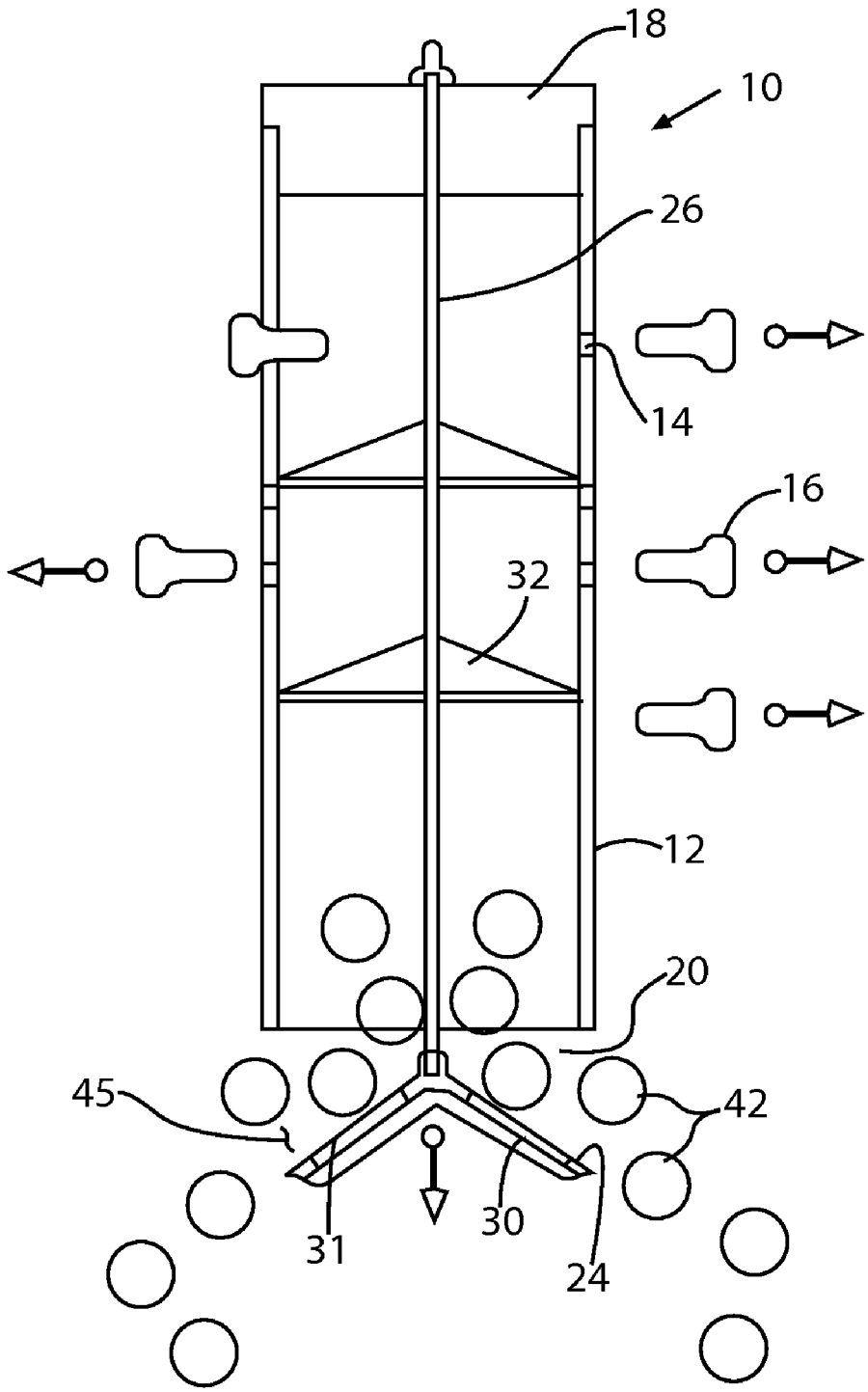
FIG. 5 is a selectively cross-sectioned view of the embodiment shown in FIG. 1, wherein the piñata system is in an open position.

Referring to FIG. 5, it can be seen that candy and prizes 42 are positioned in between the end cap assembly 30 and the lowest of the keyed platforms 32. The keyed platforms 32 rest upon the pull pins 16 and are prevented from falling down in the hollow body 12 by the presence of the pull pins 16. Some of the pull pins 16 align with the key slots 34 in the keyed platforms 32. When a pull pin 16 aligns with a key slot 34, there is no support connection made between the pull pin 16 and the keyed platform 32 at that point.

Once the keyed platforms 32 are resting on the pull pins 16 and the hollow body 12 filled with candy and prizes 42, the piñata system 10 is primed for use. The piñata system is suspended in the air. The spacer 40 around the shaft 26 above the top lid 18 is removed and the piñata system 10 is ready for play.

To play a piñata game with the piñata system 10, children are told to pull one of the pull pins 16 from the hollow body 12. If a child pulls a pull pin 16 that is not supporting a keyed platform 32, nothing happens. If a child pulls a pull pin 16 aligned with a key slot 34 on a keyed platform 32, nothing happens. Furthermore, if a child pulls a pull pin 16 that is supporting a keyed platform 32, nothing happens provided other supporting pull pin 16 remains. It is only when one pull pin 16 remains, that is supporting one of the keyed platforms 32, that the piñata system 10 can be triggered.

From FIG. 5, it can be seen that once the last supporting pull pin 16 is removed, nothing supports the keyed platforms in the hollow body 12. The keyed platforms 32 therefore fall downwardly in the hollow body 12. As the keyed platforms 32 descend, they cause the shaft 26 to descend. The shaft 26 is attached to the end cap assembly 30, and the end cap 30 descends below the bottom of the hollow body 12 and no longer obstructs the open bottom end 20 of the hollow body 12. A gap 45 therefore is created between the open bottom end 20 of the hollow body 12 and the end cap assembly 30. This gap 45 is large enough for the candy and prizes 42 to pass.

Once the candy and prizes 42 flow out of the hollow body 12, the falling candy and prizes 42 strike the end cap assembly 30 that is suspended below the hollow body 12 by the shaft 26. The pyramidal shape of the end cap assembly 30 acts as a deflector and deflects the falling candy and prizes 42 laterally. As such, the candy and prizes 42 do not fall into a confined pile, but is rather widely dispersed on the ground.

The keyed platforms 32 can be set in place on the shaft 26. In an alternate embodiment, the keyed platforms 32 may be rotatable upon the shaft 26. If the keyed platforms 32 are made to be rotatable, the top lid 18 can be removed and the position of the keyed platforms 32 changed. In such a manner, a different plurality of pull pins 16 will have to be removed to again trigger the piñata system 10.

Once the pull pins 16 are set under the keyed platforms 32, the hollow body 12 is again filled with candy and prizes 42 in the manner previously described. The piñata system 10 is then again ready for use.

It will be understood that the embodiment of the present invention piñata system that has been illustrated can be modified by a person skilled in the art using functionally equivalent components to those shown. For example, the pull pins can be replaced with the sticks of lollipops. A flexible tether can be used as a support element in place of the center shaft to support the keyed platforms and the end cap. Lateral arms extending from the shaft can take the place of the platforms. Furthermore, the hollow body can be formed into most any figure or shape. All such modification, variations and alternate embodiments are intended to be includes within the scope of the present invention as it is claimed below.

What is claimed is:

1. A reusable piñata system, comprising:

a hollow body having an open bottom end, wherein a plurality of slots are disposed in said hollow body;

an end cap sized to obstruct said open bottom end of said hollow body;

a support element coupled to said end cap, said support element extending into said hollow body through said open bottom end, wherein said support element is selectively positionable between a closed position, where said support element holds said end cap element in obstruction of said open bottom end, and an open position where said support element holds said end cap element away from said open bottom end; and a plurality of removable pull pins disposed in said slots of said hollow body, wherein said pull pins extend into said hollow body and at least some of said pull pins engage said support element to hold said support element in said closed position, wherein when all of said pull pins that engage said support element are removed, gravity causes said support element to fall to said open position, thereby moving said end cap element away from said open bottom end of said hollow body.

2. The system according to claim 1, wherein end cap has angled surfaces that face said open bottom end of said hollow body.

3. The system according to claim 1, wherein said support element includes a shaft with lateral platforms, wherein said pull pins engage said lateral platforms when said support element is in said closed position.

4. The system according to claim 3, wherein said lateral platforms are selectively positionable on said shaft.

5. The system according to claim 3, wherein said lateral platforms include at least one keyed slot that aligns with one of said pull pins.

6. The system according to claim 3, further including a spacer for engaging said shaft and retaining said support element in said closed position.

7. A method of operation for a reusable piñata, said method comprising the steps of:

providing a container having an open bottom end;

obstructing said open bottom end with a cap that is biased away from said open bottom end by gravity;

retaining said cap in obstruction of said open bottom end with a removable plurality of pull pins that extend into said container;

placing objects in said container; and pulling said pull pins out of said container until said cap falls away from said open bottom end of said container and said objects fall out of said container through said open bottom end of said container.

8. The method according to claim 7, wherein said step of obstructing said open bottom end with a cap includes providing a cap element having an elongated section that extends up into said open bottom end of said container.

9. The method according to claim 8, wherein said step of retaining said cap in obstruction of said open bottom end with a removable plurality of pull pins includes engaging said elongated section with said plurality of pull pins.

10. The method according to claim 7, further including the step of restricting said objects falling from said container so that said objects fall from said container over a prolonged period of time.

11. The method according to claim 7, further including the step of dispersing said objects as said objects fall from said container.

12. A reusable piñata system, comprising:

a container having an opening and a plurality of slots;

a closure for said opening, wherein said closure is positionable between an open position and a closed position, and wherein said closure is biased into said open position by gravity; and a plurality of identical removable elements extending into said container through said slots, wherein at least one of said removable elements retain said closure in said closed position until removed and at least some of said removable elements have no function with respect to said closure.

13. The system according to claim 12, wherein said closure includes a cap and a support element extending from said cap, wherein said support elements extends into said container through said opening.

14. The system according to claim 13, wherein said at least one of said removable elements engages said support element.

15. The system according to claim 12, wherein closure has angled surfaces that face said opening in said container.

* * * * *